US007754625B2

(12) United States Patent
Hendriks et al.

(10) Patent No.: US 7,754,625 B2
(45) Date of Patent: Jul. 13, 2010

(54) WASH-DURABLE AND COLOR STABLE ANTIMICROBIAL TREATED TEXTILES

(75) Inventors: Eugene P. Hendriks, Westford, MA (US); Jeffrey A. Trogolo, Boston, MA (US)

(73) Assignee: Aglon Technologies, Inc., Wakefield, MA (US)

( * ) Notice: Subject to any disclaimer, the term of this patent is extended or adjusted under 35 U.S.C. 154(b) by 787 days.

(21) Appl. No.: 11/644,534

(22) Filed: Dec. 22, 2006

(65) Prior Publication Data

US 2008/0152905 A1 Jun. 26, 2008

(51) Int. Cl.
*B32B 27/12* (2006.01)
*B32B 27/04* (2006.01)

(52) U.S. Cl. ..... 442/123; 442/124; 442/199; 442/200; 442/311; 442/361; 442/364; 428/373

(58) Field of Classification Search ..... 442/123, 442/124, 199, 200, 311, 361, 364; 428/373
See application file for complete search history.

(56) References Cited

U.S. PATENT DOCUMENTS

| | | | |
|---|---|---|---|
| 4,407,786 | A | 10/1983 | Drake et al. |
| 4,911,898 | A | 3/1990 | Hagiwara et al. |
| 4,911,899 | A | 3/1990 | Hagiwara et al. |
| 4,938,955 | A | 7/1990 | Niira et al. |
| 4,938,958 | A | 7/1990 | Niira et al. |
| 5,334,388 | A | 8/1994 | Hoang et al. |
| 5,405,644 | A | 4/1995 | Ohsumi et al. |
| 5,470,585 | A | 11/1995 | Gilchrist |
| 5,698,229 | A | 12/1997 | Ohsumi et al. |
| 6,296,863 | B1 | 10/2001 | Trogolo et al. |
| 6,585,989 | B2 | 7/2003 | Herbst et al. |
| 6,723,428 | B1 | 4/2004 | Foss et al. |
| 6,734,157 | B2 | 5/2004 | Radwanski et al. |
| 6,946,433 | B2 | 9/2005 | Green et al. |
| 7,132,378 | B2 | 11/2006 | Kreider et al. |
| 2005/0035327 | A1 | 2/2005 | Canada et al. |
| 2005/0037057 | A1 | 2/2005 | Schuette et al. |
| 2005/0037680 | A1 | 2/2005 | Canada et al. |
| 2005/0064020 | A1 | 3/2005 | Schutte et al. |
| 2005/0136100 | A1 | 6/2005 | Foss |
| 2005/0147657 | A1 | 7/2005 | Canada et al. |
| 2005/0183216 | A1 | 8/2005 | Harriss et al. |
| 2006/0127457 | A1 | 6/2006 | Buchalter |
| 2009/0047851 | A1* | 2/2009 | Nelson et al. ..... 442/123 |

FOREIGN PATENT DOCUMENTS

| | | |
|---|---|---|
| JP | 03-059175 | 3/1991 |
| JP | 4050367 | 2/1992 |
| JP | 4050368 | 2/1992 |
| JP | 07-304618 | 11/1995 |
| JP | 09-013279 | 1/1997 |
| JP | 09-172952 | 7/1997 |
| JP | 11012476 | 1/1999 |
| JP | 11-172581 | 6/1999 |
| JP | 2002-037643 | 2/2002 |
| WO | WO 02/45953 A1 | 6/2002 |
| WO | WO 2006/036581 A2 | 4/2006 |

OTHER PUBLICATIONS

MacKeen, Patricia C., Silver Coated Nyulon Fiber as an Antimicrobial Agent, Antimicrobial Agents and Chemotherapy, vol. 31, No. 1, Jan. 1987, p. 93-99.

* cited by examiner

*Primary Examiner*—Ula C Ruddock
(74) *Attorney, Agent, or Firm*—Edward K. Welch, II; IP&L Solutions

(57) ABSTRACT

The present invention provides for a color stable antimicrobial coatings and coating systems comprising a silver ion-exchange type antimicrobial agent. In particular, coatings and coating systems having little, if any, discoloration are provided with no loss of antimicrobial efficacy.

20 Claims, 6 Drawing Sheets

WASH-DURABLE AND COLOR STABLE ANTIMICROBIAL TREATED TEXTILES

FIELD OF THE INVENTION

The present invention relates to antimicrobial treated textiles having improved color stability and antimicrobial longevity, especially wash durability. In particular, the present invention is directed to antimicrobial treated textiles wherein the antimicrobial agent comprises a combination of a water soluble zinc salt, preferably zinc oxide, and an antimicrobial metal ion source of silver and copper ions, preferably a silver/copper ion-exchange type antimicrobial agent.

BACKGROUND OF THE INVENTION

For more than a decade now a great deal of attention has been focused on the hazards of bacterial, fungal, and viral contamination from everyday exposures. What once was a primary concern for health care facilities, especially hospitals, and food processing/food preparation facilities, is now an everyday concern for most every business, the home, schools, public transportation and so on. More virulent and, oftentimes, drug resistant strains of pathogenic bacteria are being identified around the globe. And, while such issues were once considered localized issues, they are now regional, nationwide, if not world-wide issues owing to the ease and extent to which the people of the world travel, not to mention the world-wide market place for manufactured goods and, perhaps more critically, produce and other foodstuff.

While pathogenic bacterial are certainly a major concern, they are not the only concern. The world is flush with microorganisms that may not cause death or sickness; yet they impose upon or adversely impact our lives on a daily basis. For example, molds can create an unsightly appearance in or on our homes, especially in bathrooms and basements; certain bacteria may affect the smell and/or taste of our drinking water, other bacteria affect the smell of clothing, towels, upholstery and other fabrics, etc.

Numerous efforts have been undertaken to ward off contamination and/or transmission of such bacteria, fungi and other microorganisms. Specifically, much effort has been made to introduce antimicrobial performance into a host of specialized and non-specialized products and articles of manufacture, especially those comprising or associated with touch surfaces. Such products and articles run the gamut, from cutting boards to refrigerator linings, from door knobs to cellular telephone housings, from HVAC units and components to medical devices such as stents, catheters and the like, from fabrics and textiles to wound care products, etc. This antimicrobial performance is achieved by either treating the surface of the product or article with a coating containing an antimicrobial agent or directly incorporating the antimicrobial agent into the material or composition from which the product or article is made.

While many of these applications have achieved varying degrees of commercial and technical success, one particular application, fibers, textiles and fabrics, especially for apparel, has and continues to be an area of continual developmental effort. Early on, manufacturers employed organic antimicrobial agents, most frequently triclosan, as an antimicrobial agent applied as a topical treatment or, more commonly, incorporated into the polymer melt from which the fibers/filaments are spun/extruded. However, the ability to incorporate triclosan into fiber materials is limited: showing success in acrylic and/or acetate fibers but not in polyamides, polyesters, etc. The use of triclosan has also raised certain health and safety concerns, especially with respect to skin irritation and sensitivity to the chlorine and chlorides within these compounds as well as the possible bioabsorption of the triclosan and/or its components/degradation residues into the body. Furthermore, triclosan has poor longevity in these applications due to its mobility in polymer compositions and the quickness with which it is washed out of the fabric.

In order to address some of the aforementioned problems with organic antimicrobial agents like triclosan, others have taken the approach of coating fibers, filaments and/or fabric with silver metal by, for example, vapor deposition or other electrodeless plating techniques. These methods bind the silver metal to the surface of the polymer fiber/filament. Antimicrobial performance arises from the relatively slow oxidation of the surface of the silver metal and the subsequent availability/release of antimicrobially active silver ions from the oxidized silver. Although effective and long lived, antimicrobial performance is slow owing to the rate at which the silver ions are generated, i.e., the rate of oxidation. Further compounding the efficacy of silver metal is that fact that washing of the substrate or substrate surface removes all or substantially all of the oxidized silver. Consequently antimicrobial efficacy following washing is delayed until a sufficient level of oxidation or other generation of silver ions occurs on the surface of the silver metal coating. Speed of oxidation is not the only concern, the costs of these silver coated materials are relatively high—though one can regulate the costs, at the expense of performance, by using less silver coated fiber in the fabric. Furthermore, fabrics made with these materials oftentimes have associated therewith a static nuisance owing to the electrical conductivity of the silver fibers. Finally, as would be expected, the presence of the silver coated fibers affects the color and feel of the fabric. Since these fibers do not absorb the dyes used to color the fabric, they will always stand out. The degree of their impact on the color or visual image depends upon the content of silver coated fiber in the fabric.

Another approach, one that does not suffer many of the consequences of silver metal or organic antimicrobial agents, is the use of certain inorganic silver compounds, complexes and the like. These antimicrobial agents have found growing success in the production of antimicrobial fibers, filaments, yarns, textiles, fabrics and the like. Suitable inorganic silver antimicrobial agents may take many different forms including simple silver salts or complexes, especially those antimicrobial agents comprising ceramic particles having ion-exchanged silver ions carried therein or thereon. Others include the water soluble glasses that have incorporated therein various silver ion sources.

These antimicrobial fibers, filament, yarns, textiles, fabrics and the like enable excellent antimicrobial performance, generally without the delay of the silver metal coated fibers, but have some of the same shortcomings as well as some additional problems. For example, except for hydrophilic polymers, when the antimicrobial agent is incorporated into the original polymer material, only that portion of the antimicrobial agent at or proximate to the surface of the fiber or filament made thereof is available to provide antimicrobial efficacy. Specifically, because these agents rely upon contact with water or moisture to release and transport the antimicrobial silver ion, unless there are pores in the polymer or the polymer has hydrophilic characteristics, there are no transport pathways for the ions from within the polymer. Consequently, with hydrophobic or insufficiently hydrophilic amphiphilic materials, antimicrobial efficacy is limited to those antimicrobial agents in contact with the surface of the fibers. Depending upon the denier of the fibers, there is the possibility that much of the antimicrobial agent may be wasted and non-accessible; thus, adding costs without benefit. Those applications in which the fibers, fabric, etc. are subject to wear is less affected by this phenomenon since the wear will expose previously entombed antimicrobial agent, thus rendering the fibers, fabrics, etc. self-regenerating from an antimicrobial perspective. However, in the absence of a constant wear, which also means limited life to the fabric; the antimicrobial efficacy is less predictable and very cyclical: higher performance being seen after substantial wear with loss of efficacy falling off over time as the exposed antimicrobial source is depleted and then renewed, at least somewhat, as new sources are exposed.

Another shortcoming of the inorganic silver antimicrobial agents, particularly those comprising the simple silver salts and other highly soluble silver antimicrobial agents, is their short-lived nature. Because of the limited amount of antimicrobial agent at the surface, a high degree of solubility means that the full amount of antimicrobial active at the surface can quickly be washed away or otherwise depleted. Of course, as noted above, those fibers that are subject to wear may have a replenishment of the antimicrobial activity, yet again, that which is newly exposed is quickly depleted as well. Furthermore, such wear also means that the integrity of the fiber itself, especially its strength and, in clothing, insulating property and appearance will be adversely affected. While the issue of longevity is less of a concern for "single-use" disposable type articles or infrequently laundered articles such as curtains, upholstery, etc., it is especially critical for fibers, yarns, textiles and fabrics used in apparel that is likely to be washed quite frequently, if not following each use.

Perhaps the most critical of the problems association with the inorganic silver antimicrobial agents is the impact on the color of the fiber or filament when formed as well as the long-term color stability of such fibers or filaments as well as the yarns, fabrics, textiles and like in which they are incorporated or which are treated with the same. This problem is perhaps less apparent with dark fibers, filaments, yarns, fabrics, and textiles, at least initially; but is certainly more pronounced in light colored fabrics, especially white.

Thus, despite the plethora of silver compounds and materials that could allow for the release of silver ions, the number of such compounds and materials that are suitable or possibly suitable is quickly limited due to the fact that many of these compounds and materials are themselves colorants or color altering agents. As noted, certain of these compounds will, by their mere addition, alter the color of the polymer into which they are incorporated. Others may not manifest an affect on color during the incorporation thereof; rather discoloration or coloration may occur over time. This is especially prevalent with salts and other compounds which readily dissociate or release the silver ion upon exposure to heat, moisture and/or chemically interact with other components, byproducts or contaminants of the polymer composition, especially during the processing method employed for the incorporation of the antimicrobial agent as well as the preparation of the fiber or filaments themselves. For example, the processing conditions during extrusion, melt spinning, or solution spinning may readily facilitate a chemical reaction or interaction that creates species which manifest color or which, over time, upon further exposure to environmental conditions, including light, induces the formation of color. These concerns are not limited to salts and other dissociable materials for the same problems manifest with the use of silver ion-exchange type antimicrobial agents as well, especially during manufacture and processing of the fibers, filaments, yarns, etc.

The concerns of wash-durability and discoloration have long been known. Numerous efforts have been undertaken and incremental advances have been made to address one or both of these issues. For example, Trogolo et. al.—U.S. Pat. No. 6,436,422, employed hydrophilic polymer coatings so as to enhance longevity by ensuring that all of the antimicrobial agent within the coating is available for providing antimicrobial efficacy. However, hydrophilic polymer fibers and hydrophilic polymer coated fibers have limited use due to the relatively poor physical and performance properties of the hydrophilic polymer materials themselves. Furthermore, discoloration persisted. Schutte et. al.—US2005/0064020, claims a method of preparing an antimicrobial fabric which tolerates repeated washing and avoids discoloration by treating the fabric with a silver ion delivering compound in a binder wherein the silver ion delivering compound has a defined release rate and wherein the treatment is applied "without causing discoloration of said fabric," yet it is not clear what exactly is to be done to avoid the discoloration. Green et. al.—U.S. Pat. No. 6,946,433, teach a process of preparing efficacious and wash durable textiles by applying various silver-containing ion-exchange compounds, silver-containing zeolite or silver-containing glass, or mixtures thereof, to at least a portion of a textile and then covering the same with a binder. While longevity is enhanced, color stability remains an issue. Finally, Trogolo et. al.—US 2003/0188664, teach the use of hydrophilic polymer encapsulated antimicrobial agents as additives for improved antimicrobial longevity and color stability. While all of these have made progress to the desired goal of improved longevity and/or initial and long term color stability, there is still a need for antimicrobial fibers, filaments, yarns, fabrics, textiles and the like having excellent long-term wash durability combined with excellent color stability, especially in the case of light colored and white or whitish colored fibers, filaments, yarns, fabrics and textiles.

Thus, there remains a need to provide for antimicrobial fibers, filaments, yarns, fabrics, textiles and the like which provide long lasting antimicrobial performance, especially wash durability, together with superior initial and long term color stability. In particular, there is an urgent need and strong demand for such antimicrobial fibers, filaments, yarns, fabrics, textiles, and the like, of light color, especially white.

SUMMARY OF THE INVENTION

The present invention provides for antimicrobial fibers, filaments, yarns, fabric, textiles and the like having improved color stability and antimicrobial longevity, especially wash durability. In particular, the present invention is directed to antimicrobial fibers, filaments, yarns, fabric, textiles and the like wherein the aforementioned substrates are made with or treated with an antimicrobial agent which antimicrobial agent comprises a predominant amount of a water soluble zinc salt, preferably zinc oxide, in combination with a source of antimicrobial silver and copper ions. The latter source of silver and copper ions may be a single source or it may be a combination of sources. Preferred sources of the silver and copper ions are the ion-exchange type antimicrobial agents, most preferably a single ion-exchange antimicrobial agent having both silver and copper ions ion-exchanged therein or thereon.

The antimicrobial fibers, filaments, yarns, fabric, textiles and the like may be prepared in a number of different ways depending upon the specific substrate and the stage at which the antimicrobial agent is to be introduced. For example, the antimicrobial agent may be incorporated directly into the polymer composition from which the filaments or fibers of the yarn, fabric, textile, etc. are formed or, in the case of core/sheath type fibers, into the polymer composition from which the core, the sheath or both are made. Alternatively, the antimicrobial agent may be applied to the preformed fibers, filaments, yarns, fabric, textiles and the like by use of an appropriate binder system that physically binds the antimicrobial agents to the surface thereof or by use of an appropriate solution which effects an infusion or impregnation of the antimicrobial agent into the surface of the aforementioned materials.

DETAILED DESCRIPTION OF THE INVENTION

Figure 1:
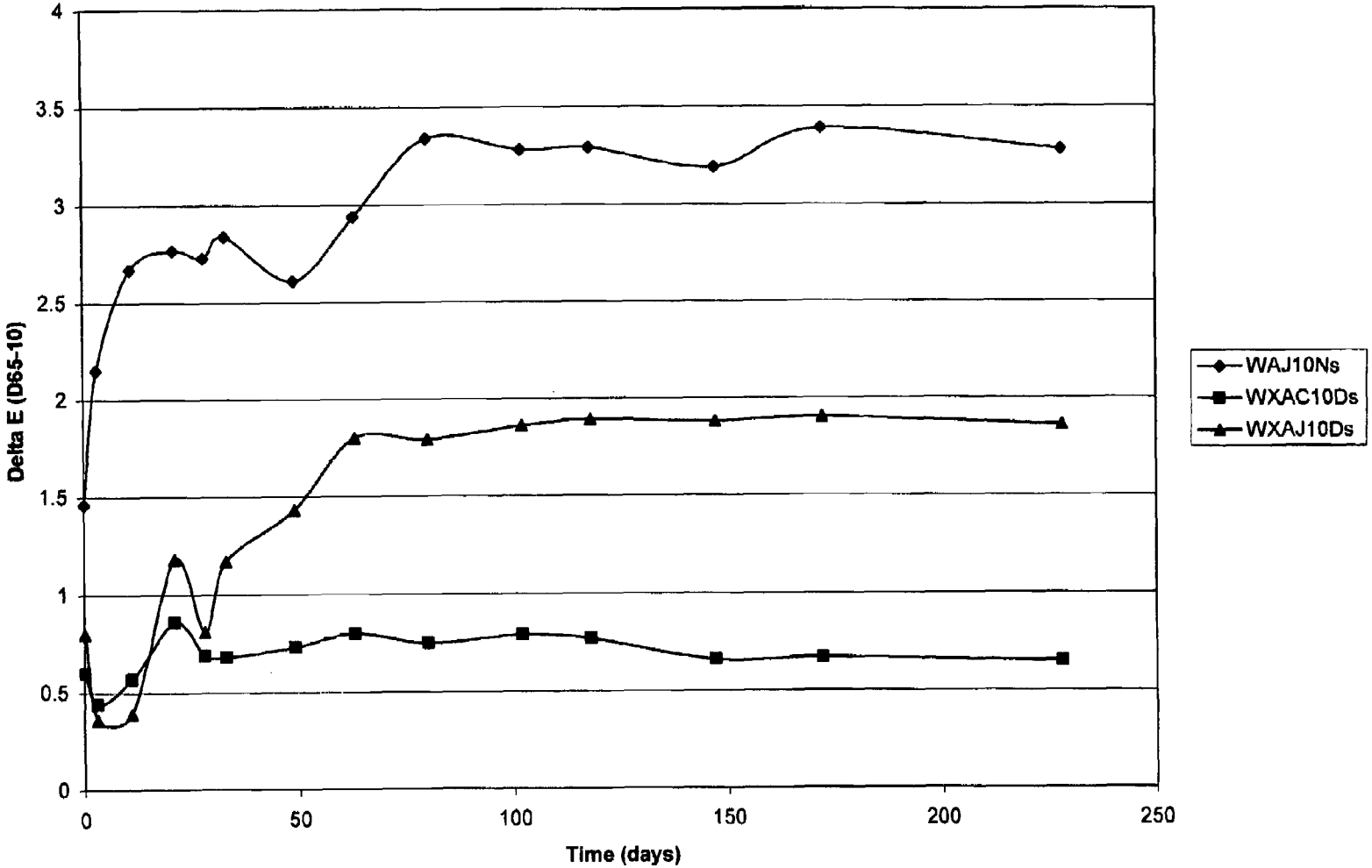
FIG. 1 shows the color change with time of antimicrobially treated white fabrics, within and outside the scope of the present invention, upon natural light exposure.

All patent applications, patents, patent publications, and literature references cited in this specification, whether referenced as such, are hereby incorporated by reference in their entirety. In the case of inconsistencies, the present description, including definitions, is intended to control.

In its most simplest or concepts, the present invention provides for fibers, filaments, yarns, fabric, textiles and the like possessing improved color stability together with excellent long-term antimicrobial efficacy, even after substantial washings. Such properties are realized by i) the use of fibers or filaments having incorporated therein a water-soluble zinc salt and a source of antimicrobial silver and copper ions or ii) by treating fibers, filaments, yarns, fabric, textiles and the like with a treatment comprising a water-soluble zinc salt and a source of antimicrobial silver and copper ions.

As used herein and as context allows, the terms "textile" and "textiles" are intended to include fibers, filaments, yarns and fabrics, including knits, wovens, non-wovens, and the like. For purposes of this invention, textiles may be composed of or made from natural fibers, synthetic fibers or both. Textiles in the form of fibers and yarns may be of any size or denier, including microdenier fibers and yarns (fibers and yarns of less than one denier per filament). In one embodiment, the fibers and yarns will preferably have a denier that ranges from less than about 1 denier per filament to about 2000 denier per filament, more preferably from less than about 1 denier per filament to about 500 denier per filament.

It is also contemplated that the fibers or yarns may be multi-component or bi-component fibers or yarns, including those that may be splittable, or which may have been partially or fully split, along their length by chemical or mechanical action as well as those of the core-sheath type construction. The fibers or yarns may be multi- or mono-filament, may be false-twisted or twisted, or may incorporate multiple denier fibers or filaments into one single yarn through twisting, melting and the like. Fabrics may be formed of any of the foregoing fibers and yarns or combinations thereof. For example, a fabric may be wholly or partially made of multi- or bi-component fibers and yarns. Additionally, the fabrics may be made of fibers and yarns of different compositional make-up, including combinations of natural and synthetic fibers and yarns, combinations of natural fibers and yarns, or combinations of synthetic fibers and yarns. Fabrics may be comprised of fibers and yarns such as staple fibers, filament fiber, spun fiber, or combinations thereof. Furthermore, the textiles may be comprised of antimicrobial fibers and yarns in combination with fibers and yarns free of the antimicrobial agents.

As noted, the textiles may be composed of or made from natural or synthetic fibers. Natural fibers include wool, cotton, flax and blends thereof. Synthetic fibers include fibers made of, for example, polyesters, acrylics, polyamides, polyolefins, polyaramids, polyurethanes, regenerated cellulose (i.e., rayon) and blends thereof. More specifically, polyester fibers include, but are not limited to, polyethylene terephthalate, poly(trimethylene terephthalate), poly(triphenylene terephthalate), polybutylene terephthalate, aliphatic polyesters (such as polylactic acid (PLA), and combinations thereof, and are generally characterized as long chain polymers having recurring ester groups. Polyamides include, but are not limited to, nylon 6; nylon 6,6; nylon 12; nylon 6,10, nylon 1,1 and the like and are characterized by long-chain polymers having recurring amide groups as an integral part of the polymer chain. Polyolefins include, but are not limited to polypropylene, polyethylene, polybutylene, polytetrafluoroethylene, and combinations thereof. Polyaramids include, but are not limited to, poly-p-phenyleneterephthalamid (i.e., Kevlar®), poly-m-phenyleneterephthalamid (i.e., Nomex®), and combinations thereof.

The textile substrate may be dyed or colored with any type of colorant, such as for example, poly(oxyalkylenated) colorants, as well as pigments, dyes, tints and the like, to provide other aesthetic features for the end user. Other additives may also be present on and/or within the textile substrate, including antistatic agents, brightening compounds, nucleating agents, antioxidants, UV stabilizers, fillers, permanent press finishes, softeners, lubricants, curing accelerators, and the like. Particularly desirable as optional supplemental finishes to the treated textiles of the present invention are soil release agents, which improve the wettability and washability of the textile. Preferred soil release agents include those that provide hydrophilicity to the surface of the textile. All of such additional materials are well known to those skilled in the art and are commercially available.

The inventive antimicrobial textiles in accordance with the practice of the present invention comprise, either as a component thereof or a treatment applied thereto, a water-soluble zinc salt in combination with a source of antimicrobial silver and copper ions. The source of silver and copper ions may be a single source or it may be a combination of sources. Preferred sources of the silver and copper ions are the ion-exchange type antimicrobial agents, most preferably a single ion-exchange antimicrobial agent having both silver and copper ions ion-exchanged therein or thereon.

Suitable water-soluble zinc salts are preferably ones that, in their natural state, are white or have a very faint color and, most preferably, do not change color upon exposure to light or moisture or under conditions of polymer compounding. Typically they are characterized as the simple salts of zinc, either inorganic salts or organic salts, the latter being especially the carboxylic acid salts. Exemplary zinc salts suitable for use in the practice of the present invention include, but are not limited to, zinc oxide, zinc acetate, zinc borate, zinc nitrate, zinc sulfate, zinc chloride, zinc bromide, zinc nitrate, zinc hydrophosphite, zinc oxalate, zinc oleate, zinc peroxide, and the like. Preferably the zinc salt is one that also manifests antimicrobial properties. Most preferably the zinc salt is selected from zinc oxide, zinc acetate, zinc borate, and zinc nitrate.

The second component of the antimicrobial agent is the source of antimicrobial silver and copper ions, this may be a single source or a combination of sources, each source being individually selected from the group consisting of antimicrobial metal containing water soluble glasses and ion-exchange type antimicrobial agents. Preferably, the antimicrobial agent is a single source providing both silver and copper ions.

Antimicrobial water soluble glasses, especially the silver glasses, are commercially available, and are described in, e.g., lshii et. al.—U.S. Pat. No. 6,831,028; Namaguchi et. al. U.S. Pat. No. 6,939,820; Nomura—U.S. Pat. No. 6,593,260; Shimiono et. al.—U.S. Pat. No. 5,290,544; Gilchrist—U.S. Pat. No. 5,470,585; and Drake—U.S. Pat. No. 4,407,786, which are incorporated herein by reference. They are characterized as being similar to typical glasses except that the traditional glass former, silicon dioxide, is replaced, in whole or in part, with phosphorus pentoxide ($P_2O_5$) as the principal glass former. Other components include various oxides including, for example, CaO, $Na_2O$, MgO, $Al_2O_5$, ZnO, $B_2O_3$, etc. Typically these compositions will have from about 35 to about 75 mole percent, preferably from about 40 to about 60 mole percent, of the phosphorous pentoxide and from about 5 top about 55 mole percent, preferably from about 10 to about 40 mole percent, of a metal oxide, e.g., a Group IA or Group IIA metal oxide such as sodium oxide or calcium oxide. Antimicrobial properties are achieved by incorporation of water-soluble, simple metal salts of silver and/or copper, such as silver oxide and cupric oxide. The antimicrobial additive is present in the glass in the range of from about 1 to about 20%, preferably from a bout 3 to about 15% by weight based on the total weight of the antimicrobial water soluble glass.

Antimicrobial water soluble glasses are available from a number of sources including Ishazuka Glass Co., Ltd., the latter selling silver glass under the tradename "Ionpure." Antimicrobial glasses dissolve and/or swell upon exposure to water, including, though more slowly, atmospheric moisture, thereby releasing or making available the antimicrobial metal ion source within the glass. By suitable adjustment of the glass composition, the dissolution rates in water can be controlled, thereby controlling the release of the antimicrobial metal ions and, hence, extending their longevity.

Alternatively, the antimicrobial agent may be in the form of an ion-exchange type antimicrobial agent or combinations of such agents. Ion-exchange type antimicrobial agents are typically characterized as comprising a ceramic particle having ion-exchanged antimicrobial metal ions, i.e., the antimicrobial metal ions have been exchanged for (replaced) other non-antimicrobially effective ions in and/or on the ceramic particles. Additionally these materials may have some surface adsorbed or deposited metal; however, the predominant antimicrobial effect is as a result of the ion-exchanged antimicrobial metal ions.

Antimicrobial ceramic particles include, but are not limited to zeolites, calcium phosphates, hydroxyapatite, zirconium phosphates and other ion-exchange ceramics. These ceramic materials come in many forms and types, including natural and synthetic forms. For example, the broad term "zeolite" refers to aluminosilicates having a three dimensional skeletal structure that is represented by the formula: $XM_2/nO—Al_2O_3—YSiO_2—ZH_2O$ wherein M represents an ion-exchangeable ion, generally a monovalent or divalent metal ion; n represents the atomic valency of the (metal) ion; X and Y represent coefficients of metal oxide and silica, respectively; and Z represents the number of water of crystallization. Examples of such zeolites include A-type zeolites, X-type zeolites, Y-type zeolites, T-type zeolites, high-silica zeolites, sodalite, mordenite, analcite, clinoptilolite, chabazite and erionite. The present invention is not restricted to use of these specific zeolites.

Generally speaking, the ion-exchange type antimicrobial agents used in the practice of the present invention are prepared by an ion-exchange reaction in which non-antimicrobial ions present in the ceramic particles, for example sodium ions, calcium ions, potassium ions and iron ions in the case of zeolites, are partially or wholly replaced with the antimicrobial copper and silver ions. The combined weight of the antimicrobial metal ions will be in the range of from about 0.1 to about 35 wt %, preferably from about 2 to 25 wt %, most preferably from about 4 to about 20 wt % of the ceramic particle based upon 100% total weight of ceramic particle wherein the weight ratio of silver to copper ions is from 1:10 to 10:1, preferably from 5:1 to 1:5, most preferably from 2.5: to 1:2.5. In particular each antimicrobial metal ion may be present in the range of from about 0.1 to about 25 wt %, preferably from about 0.3 to about 15 wt %, most preferably from about 2 to about 10 wt % of the ceramic particle based on 100% total weight of the ceramic particle. In an especially preferred embodiment, the ceramic particle contains from about 0.3 to about 15 wt % of silver ions and from about 0.3 to about 15 wt % of copper ions in a weight ratio of 5:1 to 1:5. Where a plurality of sources is employed, at least one of which serves as a source of copper ions, each source will generally meet the foregoing limitations.

In addition to the copper and silver ions, the antimicrobial ceramic particles may also have other ion-exchanged antimicrobial metal ions such as zinc ions. If present these additional antimicrobial metal ions will be present in the ranges set forth above for the silver and copper ions and will be included in the total weight of antimicrobial metal ions also mentioned above. Alternatively, or in addition thereto, these ion-exchange type antimicrobial agents may also contain an additional discoloration agent. Preferably, the discoloration agent is biocompatible. Preferred discoloration agents include, but are not limited to, inorganic discoloration inhibitors such as ammonium. More preferably, the inorganic discoloration inhibitor is an ion-exchanged ammonium ion. The ammonium ions, if present, will be present in an amount of up to about 20 wt % of the ceramic particle though it is preferred to limit the content of ammonium ions to from about 0.1 to about 2.5 wt %, more preferably from about 0.25 to about 2.0 wt %, and most preferably from 0.5 to about 1.5 wt % of the ceramic particle.

Various grades of the above-mentioned Ion-exchange type antimicrobial agents are widely available and well known to those skilled in the art. Hydroxyapatite particles containing antimicrobial metal ions are described in, e.g., Sakuma et. al.—U.S. Pat. No. 5,009,898 and U.S. Pat. No. 5,268,174. Zirconium phosphates containing antimicrobial metal ions are described, e.g., in Tawil et. al.—U.S. Pat. No. 4,025,608; Clearfield—U.S. Pat. No. 4,059,679; Sugiura et. al.—U.S. Pat. No. 5,296,238; and Ohsumi et. al.—U.S. Pat. No. 5,441, 717 and U.S. Pat. No. 5,405,644, as well as in the Journal of Antibacterial and Antifungal Agents, Vol. 22, No. 10, pp. 595-601, 1994. Antimicrobial zeolites containing antimicrobial metal ions are described in, e.g., U.S. patent Nos. Hagiwara et. al.—U.S. Pat. No. 4,911,898; U.S. Pat. No. 4,911,899; and U.S. Pat. No. 4,775,585; Niira et. al.—U.S. Pat. No. 4,938,955 and U.S. Pat. No. 4,938,958; and Yamamoto et. al.—U.S. Pat. No. 4,906,464. Especially preferred ion-exchange type antimicrobial agents are those based on the zeolite carrier. Such materials are commercially available from, e.g., AgION Technologies, Inc., of Wakefield, Mass., USA under the AgION tradename. One particularly desirable ion-exchange antimicrobial zeolite is that sold under the grade designation AC10D and comprising Type A zeolite particles having a mean average diameter of about 3μ having approximately 6.0% by weight of ion-exchanged copper ions and 3.5% ion-exchanged by weight silver ions.

As noted above, the source of the copper and silver ions may be a single source that provides both the silver and copper ions or it may be two or more individual sources at least one of which acts as source of the silver ions and at least one of which acts as a source of copper ions. Alternatively, depending upon the antimicrobial performance desired and the color stability issues encountered, one may employ one antimicrobial agent that provides both the copper and silver ions and another that provides one or the other, as a supplement to the combined source. In this respect, while the focus of the foregoing discussion on suitable antimicrobial agents has been with respect to a single source providing both metal ions, those skilled in the art will readily appreciate that their manufacture can be readily and easily adjusted to manufacture such agents which provide just one or the other of the silver and copper ions.

Where a plurality of silver and/or copper ion sources are employed, each source may be of the same type or of a different type. For example, one may employ two or more different antimicrobial zeolites, two or more different water-soluble antimicrobial glasses, two or more zirconium phosphates, etc. Alternatively, one may employ combinations of such antimicrobial agents, for example, combinations of antimicrobial zeolite and antimicrobial water-soluble glass, combinations of zirconium phosphate and antimicrobial water-soluble glass, combinations of zirconium phosphate and zeolite, combinations of calcium phosphate and zeolite, etc. Again, where a combination of silver and/or copper ion sources is employed, at least one serves as a source of silver ions and at least one serves as a source of copper ions. Such materials are widely available commercially, especially those serving as a source of silver ions: those with copper, alone or in combination with silver, are fewer in number. For example, the above-mentioned AgION Technologies, Inc. offers a wide variety of silver based antimicrobial zeolites such as those sold under the AgION trademark with grade designations AW10D (0.6% by weight of silver ion-exchanged in Type A zeolite particles having a mean average diameter of about 3μ), AG10N and LG10N (2.5% by weight of silver ion-exchanged in Type A zeolite particles having a mean average diameter of about 3μ and 10μ, respectively); AJ10D (2.5% silver, 14% by weight zinc, and between 0.5% and 2.5% by weight ammonium ion-exchanged therein in Type A zeolite having a mean average diameter of about 3μ); AK10D (5.0% by weight of silver ion-exchanged in Type A zeolite particles having a mean average diameter of about 3μ). Antimicrobial silver zirconium phosphates are available from Milliken Chemical Company of Spartenburg, S.C. under the tradename AlphaSan. Antimicrobial silver hydroxyapatites are available from Sangi Company Ltd. of Tokyo, Japan under the tradename Apacider.

While the aforementioned zinc salts and silver and copper ion source are typically employed in their neat form, it is also contemplated that they may be employed in an encapsulated form wherein discrete particles of each are individually coated with a hydrophilic material or a plurality of particles of each component of the antimicrobial agent are, individually or in combination, dispersed in discrete particles of a hydrophilic material. Of course, in both cases, it is also contemplated that only one component of the antimicrobial agent be encapsulated and the other employed in its neat form. Suitable encapsulated antimicrobial materials and their methods of manufacture are described in Trogolo et. al.—US2003-0118664 A1 (Corresponds to WO 03/055941A1), which is incorporated herein by reference.

For use in the practice of the present invention, these encapsulated antimicrobial agents will be in the form of spherical or ellipsoid particles having a low aspect ratio, for example, on the order of from 1 to about 4, preferably from 1 to about 2, most preferably from 1 to about 1.5 and an average diameter of 200μ or less, preferably 50μ or less, most preferably 25μ or less. The ultimate size of the particles depends upon the method of their use in the practice of the present invention. For example, when the antimicrobial agent is to be incorporated into the polymer comprising the fiber or filaments or a layer thereof or is to be applied as a component of a coating to individual fibers or filaments, it is important that the encapsulated antimicrobial agents be 25μ or less, preferably less and most preferably in the form of particles of the antimicrobial agent individually coated with the hydrophilic polymer at a thickness of less than 12μ, preferably less than 5μ, most preferably less than 2.5μ. The use of such small particles avoids or minimizes any detrimental impact the presence of such particles may have on the integrity or strength of the fibers or filaments made of the polymer composition into which they are incorporated. Similarly, when applied to the surface of individual fibers, the larger the particle the greater the tendency for the particles to be scraped off during processing, weaving, knitting, etc. of the fibers or filaments. In addition, the rougher surface of the larger particle size treated fibers and filaments will tend to wear or abrade the surface of other fibers, thus affecting integrity and strength, during processing, weaving, knitting, etc. On the other hand, where a yarn, fabric or textile is to be treated as a whole, the larger particle size may allow for higher loading of the antimicrobial agent and provide a secondary method by which the antimicrobial agents are fixed to the same: namely, the larger particles may become more physically entrained or trapped in and amongst the individual fibers or filaments of the yarn, fabric or textile.

Finally, another factor affecting the use of these encapsulated antimicrobial agents is the selection of the hydrophilic polymer itself. This is especially important when the antimicrobial agent is incorporated into the polymer or one of the polymers from which the fibers or filaments is made. Specifically, it is important to select hydrophilic polymers that are compatible with the matrix polymer into which they are to be incorporated; otherwise, strength and other physical properties of the fiber or filaments, and hence the ultimate textile, will be adversely affected. Compatibility is also an issue for antimicrobial coatings since the binder must physically hold the antimicrobial agents to the surface of the textile. If there is an incompatibility between the binder and the hydrophilic polymer, the antimicrobial agent will be readily scraped from the surface of the treated textile.

The total amount of the antimicrobial agent as well as the weight ratio of the zinc salt and silver and copper ion source present in and/or on the antimicrobial textiles depends upon a number of factors including whether the antimicrobial agent is to be incorporated into the matrix of the fibers or filaments or applied to the surface of the textiles; any governmental rules, regulations, standards, etc. regulating the use of such materials in the given textile applications; the costs associated with a given level of antimicrobial performance and longevity, etc. Generally speaking, the combined weight of the zinc salt and the silver and copper ion source will be from about 0.01 to about 20 weight percent, preferably from about 0.02 to about 10 weight percent, most preferably from about 0.05 to about 5 weight percent based on the total weight of the antimicrobial textile or, in the case of textiles comprising both antimicrobially treated and untreated fibers, filaments, yarns, etc., that portion thereof which is treated with the antimicrobial agent. Furthermore, the two antimicrobial additives will be present in a weight ratio of zinc salt to silver and copper ion source of from about 1:1 to about 20:1, preferably from about 2:1 to about 10:1. Individually, the amount of zinc salt will range from about 0.008 to about 16 weight percent, preferably from about 0.016 to about 8 weight percent, most preferably from about 0.04 to about 4 weight percent, based on the weight of the treated textile, as defined above. Similarly, the amount of silver and copper ion source will range from about 0.002 to about 4 weight percent, preferably from about 0.004 to about 2 weight percent, most preferably from about 0.01 to about 1 weight percent, based on the weight of the treated textile, as defined above. Where either or both components of the antimicrobial agent is present in an encapsulated form, as discussed above, the aforementioned weight percents for the components of the antimicrobial agent are based upon the neat antimicrobial component, excluding the encapsulating hydrophilic polymer.

In following with the foregoing discussion, it is clear that the antimicrobial textiles of the present invention may be prepared in many different ways. First, the antimicrobial agents may be directly incorporated into the polymer material from which the individual fibers or filaments are extruded, melt spun, solution spun, etc. In the case of core/sheath and other bi- or multi-component fibers, the antimicrobial agent is incorporated into the polymer composition of at least one of the polymer components employed in making the fiber: most notably and preferably the outer most layer or an exposed layer of component of the fiber or filament. One or both components of the antimicrobial agent may also be incorporated into the core or a component of the fiber or filament which does not have an exposed surface so long as the sheath or overlaying component is hydrophilic so as to allow for the transport of the antimicrobial active through the sheath or overlaying component to the surface of the fiber or filament. Preferably, the amount of the antimicrobial agent to be incorporated into the polymer composition generally ranges from about 0.1 to about 50 weight percent, most preferably from about 0.5 to about 20 weight percent based on the total weight of the antimicrobial polymer composition. The amount of each component of the antimicrobial agent and the ratio thereof will be as set forth above.

Alternatively, the antimicrobial textiles according to the present invention may be prepared by treating the textile with a coating composition comprising the antimicrobial agent and a binder. The coating composition may be a 100% solids based or a "solvent" based system such as true solutions, dispersions or colloids. 100% solid compositions are flowable compositions that cure or set upon exposure to the atmosphere or other curing conditions. While avoiding the environmental, health and safety concerns associated with the use of solvents, 100% solids binder compositions suffer from higher viscosity and, therefore, are more difficult to employ with textiles, especially where the intent is to get an even coating of the antimicrobial agent on the textile surface without adding bulk to the individual fibers or filaments or the textiles as a whole.

Binder systems are well known and are currently used for altering and/or providing other textile modifiers to the surfaces of textiles. Especially suited binders are commonly referred to as finishing agents for the textile industry. While it appears that the preferred binders are those based on polyurethanes or acrylics, especially anionic or lightly anionic acrylics, in practice essentially any effective cationic, anionic, or non-ionic binder resin may be used. Most preferably, the binder resin is non-ionic or slightly anionic. Suitable non-ionic binders include those based on polyurethane such as those available from BASF under the tradename Lurapret as well as binder resins selected from the group consisting of non-ionic permanent press binders (i.e., cross-linked adhesion promotion compounds) including, without limitation, cross-linked imidiazolidinones such as those available from Sequa under the tradename Permafresh. Anionic and slightly anionic binders include various acrylics, such as Rhoplex TR3082 from Rohm & Haas and those sold by BASF under the tradename Helizarin. Other potential binder resins include, but are not limited to melamine formaldehyde, melamine urea, ethoxylated polyesters (such as Lubril QCX from Rhodia), and the like. Oftentimes there binders will also contain other surfactants, leveling agents and the like. Preferred binder systems are those having an aqueous or aqueous-based carrier or solvent.

Typically the binder system will comprise from about 0.1 to about 60 weight percent, most preferably from about 1 to about 40 weight percent of the antimicrobial agent (i.e., the combination of the zinc salt and the silver and copper ion source) based on the total weight of binder system. The amount of each component of the antimicrobial agent and the ratio thereof in the solidified binder resin will be as set forth above. These antimicrobial binder systems may also contain one or more co-constituents for modifying or altering the textile surface or properties. For example, these antimicrobial binder systems may further include UV or thermal stabilizers, adhesion promoters, dyes or pigments, leveling agents, odor absorbing agents, thickeners and the like. Each will be present in their traditional amounts for the particular textile or end-use application thereof.

The present invention is especially suitable for use with colored coatings, i.e., those containing dyes and pigments, given the improvement in color stability resulting from the presence of the silver/copper containing antimicrobial agents. The specific additives to be use and the amount by which they can be used in the coating formulations of the present invention will depend upon the end use application and the choice of the polymer. Generally speaking, though, the selection and level of incorporation will be consistent with the directions of their manufacturers and/or known to those skilled in the art.

The antimicrobial binder systems may be applied by any of the methods known in the art, including spraying, brushing, rolling, printing, dipping and the like. Typically these antimicrobial binder systems will be applied so as to provide as thick a coating as possible while concurrently providing the needed degree of antimicrobial performance. Such rate of applications will be consistent with the manufacturer stated or art recognized rate of application for the neat (i.e., without antimicrobial agent) binder or finishing system. Most preferably, the rate of application will be such as to provide from about 0.01 to 20 weight percent, preferably from about 0.02 to 10 weight percent antimicrobial binder system based on the combined weight of the binder system and textile.

While the foregoing discussion has been on the basis that antimicrobial agent is incorporated into the binder system, those skilled in the art will also recognize that the antimicrobial agent and binder system may be applied to the textile in two separate steps according to two different methodologies. In the first, the textile is first wetted with the binder system and the antimicrobial agent dusted onto the wetted surface. The antimicrobial agent essentially resides on the outer surface of the subsequently cured or hardened binder resin. Alternatively, though this may be limited to yarns and, more especially fabrics and textiles, the surface of the yarn, fabric or textile may be dusted with the antimicrobial agent and then the dusted surface treated with the binder system: thereby encapsulating or potting the particles of the antimicrobial agent to the textile surface.

Finally, although less desirable, it is also contemplated that the antimicrobial agent may be applied to the surface of the textile by suspending the antimicrobial agent in an appropriate solvent, one that is capable of swelling the polymer from which the textile is made, such that the antimicrobial agent is impregnated into the surface layer of the textile upon swelling of the same and is deposited there once the solvent evaporates.

The antimicrobial textiles made in accordance with the practice of the present invention have many and varied uses. For example, they may be used in sutures, wound dressings, apparel, upholstery, bedding, wipes, towels, gloves, rugs, floor mates, drapery, napery, textile bags, awnings, vehicle covers, boat covers, tents, and the like. Because of the color stability and the wash durability, they are especially beneficial and suited for use in applications where the end-use article is subject to repeated washing or exposed to natural conditions, especially rain.

The following examples are merely illustrative of the invention and are not to be deemed limiting thereof. Those skilled in the art will recognize many variations that are within the spirit of the invention and scope of the claims.

Antimicrobial Fabrics

Three rolls of white polyester fabric were treated with an aqueous acrylic based binder system containing one of three antimicrobial agents: a silver zeolite (AgION WAJ10N), a combination of silver zeolite and zinc oxide (AgION XAJ10N); and a combination of a silver/copper zeolite and zinc oxide (AgION XAC10N). These antimicrobial treatments were prepared by adding the acrylic binder to an aqueous-based slurry of each of the antimicrobial agents under high shear mixing conditions for a sufficient period of time to create a substantially homogeneous mixture. Each of the tested slurries is available from AgION Technologies, Inc. of Wakefield, Mass. and comprises 20 percent by weight, based on the total weigh of the slurry, of the antimicrobial agents set forth in Table 1.

TABLE 1

| | Antimicrobial Agent* | | |
|---|---|---|---|
| Component | WAJ10N | XAJ10N | XAC10N |
| zeolite carrier having 2.5 wt. % silver ions | 100 | 20 | — |
| zeolite carrier having 3.5 wt. % | | — | 20 |
| Zinc oxide | | 80 | 80 |

*Presented as parts by weight based on 100 parts of the specified antimicrobial agent A fourth roll of the fabric was also treated with the acrylic binder solution free of the antimicrobial agent. The treated fabrics were then cut into squares of various sizes for testing as set forth below.

Antimicrobial Efficacy and Wash Durability

Fifteen 24" by 24" sections of each fabric were cut from the rolls. These were divided into five sets of three sheets each and subjected to 0, 20, 40, 60 and 80 wash cycles, each wash cycle comprising washing in a standard washing machine set at regular wash setting with 3 oz. of Tide laundry detergent. Each sample was then evaluated for silver and copper elution (release) as well as antimicrobial efficacy against *staphylococcus aureus*. Silver and copper elution were evaluated by cutting 2" by 2" sections from each fabric panel and soaking them in 40 ml of an 0.8% sodium nitrate ($NaNO_3$) solution with rocking for 24 hours. Silver and copper content was measured by Graphite Furnace Atomic Absorption (GFAA).

Concurrently, antimicrobial performance of each of the fabrics was evaluated in accordance with the Dow Shaker Test (ASTM E2149). Specifically, approximately 0.5 g samples of each fabric was placed in individual receptacles containing 25 ml of an inoculum Buffer having 1.09E5 CFU/ml of *staphylococcus aureus*, as determined by plate count enumeration. Each sample was placed on a shaker and maintained at room temperature for 24 hours. An organism count was then made on each sample as well as the inoculum and the percent reduction (based on the original inoculum) determined.

The results of the ion assays and bio-efficacy tests for each sample are presented in Table 2. As can be seen, the inventive antimicrobial textiles provided longer-lived antimicrobial performance as compared to those textiles treated with a silver zeolite alone or a combination of a silver zeolite and zinc oxide. Indeed, a noted drop in bioefficacy was seen after 60 washings in the samples treated with just the silver zeolite despite the fact that these samples continued to release higher levels of silver. It is believed that the zinc, though only marginally active as an antimicrobial by itself, contributed to antimicrobial performance and/or interfered with other interactions of the silver ions so as to ensure more silver ions were available for antimicrobial performance. Even so, the benefit appeared to be lost by the $80^{th}$ washing as seen with the XAJ treated samples. Nonetheless, high antimicrobial performance remained for the inventive treatments comprising the silver/copper zeolites with zinc oxide. While the difference between a 99.8 and 99.9 kill rate may seem minimal, those skilled in the art recognize the significance of each increase in log kill as being a marked improvement, especially where pathogenic bacteria are concerned.

Color Stability

Samples of the treated fabrics were also evaluated for color stability. Specifically, 6" by 6" samples of each fabric were cut and left in a south facing

TABLE 2

| Fabric and sample number | No Wash Cycles Ion Extraction $Ag^+$ | No Wash Cycles Ion Extraction $Cu^+$ | No Wash Cycles Bioefficacy @ 24 Hours (1.09E5 @ $T_o$) CFU/ml | No Wash Cycles Bioefficacy @ 24 Hours % Red. | 20 Wash Cycles Ion Extraction $Ag^+$ | 20 Wash Cycles Ion Extraction $Cu^+$ | 20 Wash Cycles Bioefficacy CFU/ml | 20 Wash Cycles Bioefficacy % Red. | 40 Wash Cycles Ion Extraction $Ag^+$ | 40 Wash Cycles Ion Extraction $Cu^+$ | 40 Wash Cycles Bioefficacy CFU/ml | 40 Wash Cycles Bioefficacy % Red. |
|---|---|---|---|---|---|---|---|---|---|---|---|---|
| Assay | | | 3.2E5 | N/A | | | | | | | | |
| Control | 0 | 3.7 | 5.7E4 | 47.7 | | | | | | | | |
| Control | 5.2 | 5 | 1.5E4 | 86.2 | | | | | | | | |
| Control | 0 | 3.7 | 8.3E4 | 23.8 | | | | | | | | |
| WAJ | 117 | 2.5 | <10 | 99.98 | 12 | | 2.0E1 | 99.96 | 7.6 | | <10 | 99.98 |
| WAJ | 106 | 1 | <10 | 99.98 | 14 | | 2.0E1 | 99.96 | 6.5 | | <10 | 99.98 |
| WAJ | 100 | 1.5 | <10 | 99.98 | 15 | | 2.0E1 | 99.96 | 15 | | 1.4E2 | 99.73 |
| XAJ | 38 | 2.1 | <10 | 99.98 | 7.3 | | <10 | 99.98 | 3.2 | | <10 | 99.98 |
| XAJ | 64 | 0 | <10 | 99.98 | 7.1 | | <10 | 99.98 | 4.2 | | <10 | 99.98 |
| XAJ | 60 | 0 | <10 | 99.98 | 6.7 | | 1.0E1 | 99.98 | 3 | | <10 | 99.98 |
| XAC | 62 | 84 | <10 | 99.98 | 6.6 | 10 | <10 | 99.98 | 3.5 | 18 | <10 | 99.98 |
| XAC | 51 | 16 | <10 | 99.98 | 6.5 | 6 | <10 | 99.98 | 3.4 | 18 | 1.0E1 | 99.98 |
| XAC | 3 | 15 | <10 | 99.98 | 6.6 | 13 | <10 | 99.98 | 3.3 | 20 | <10 | 99.98 |

| Fabric and sample number | 60 Wash Cycles Ion Extraction $Ag^+$ | 60 Wash Cycles Ion Extraction $Cu^+$ | 60 Wash Cycles Bioefficacy CFU/ml | 60 Wash Cycles Bioefficacy % Red. | 80 Wash Cycles Ion Extraction $Ag^+$ | 80 Wash Cycles Ion Extraction $Cu^+$ | 80 Wash Cycles Bioefficacy CFU/ml | 80 Wash Cycles Bioefficacy % Red. |
|---|---|---|---|---|---|---|---|---|
| Assay | | | | | | | | |
| Control | | | | | | | | |
| Control | | | | | | | | |
| Control | | | | | | | | |
| WAJ | 8.9 | | 5.3E2 | 98.98 | 3.1 | | 1.0E1 | 99.98 |
| WAJ | 10 | | 2.9E2 | 99.44 | 3.6 | | 5.4E2 | 98.96 |
| WAJ | 14 | | 7.5E2 | 98.56 | 4.6 | | 5.4E2 | 98.96 |
| XAJ | 6.5 | | 2.0E1 | 99.96 | 2.3 | | 2.9E3 | 94.42 |
| XAJ | 5.2 | | 1.0E1 | 99.98 | 1.9 | | 4.1E3 | 92.12 |
| XAJ | 4.1 | | <10 | 99.98 | 3.3 | | 1.9E4 | 63.46 |
| XAC | 6.3 | 12 | 1.0E1 | 99.98 | 2.7 | 5.4 | 3.0E2 | 99.42 |
| XAC | 5.9 | 12 | <10 | 99.98 | 1.9 | 5 | 7.0E1 | 99.87 |
| XAC | 4.1 | 7.8 | 3.0E1 | 99.94 | 2.1 | 5 | 5.1E3 | 90.19 |

window to expose the samples to natural light. An additional set of non-washed samples measuring 2" by 2" were cut and placed in a Xenon chamber, model No. QSUN/1000 manufactured by Q Panel Lab Products, Inc. of Cleveland, Ohio, maintained at 45° C. at an intensity of 0.72 and wavelength 420 nanometers. The latter simulates an accelerated exposure condition.

Color stability was determined using a Minolta spectrophotometer Model No. CM3600d. As known to those skilled in the art, this spectrophotometer measures the color shift from a given reference color or color point in the multidimensional color space: in this case the control fabric. Measurements are made at three angles and the color shift, for each angle, reported as a Delta E. The greater the Delta E, the more pronounced the color shift. Typically, a Delta E of 3 or more is needed before the shift becomes readily visible to the naked eye. The results of these experiments are presented in graph form showing color change over time in FIGS. 1 through 6.

Figure 2:
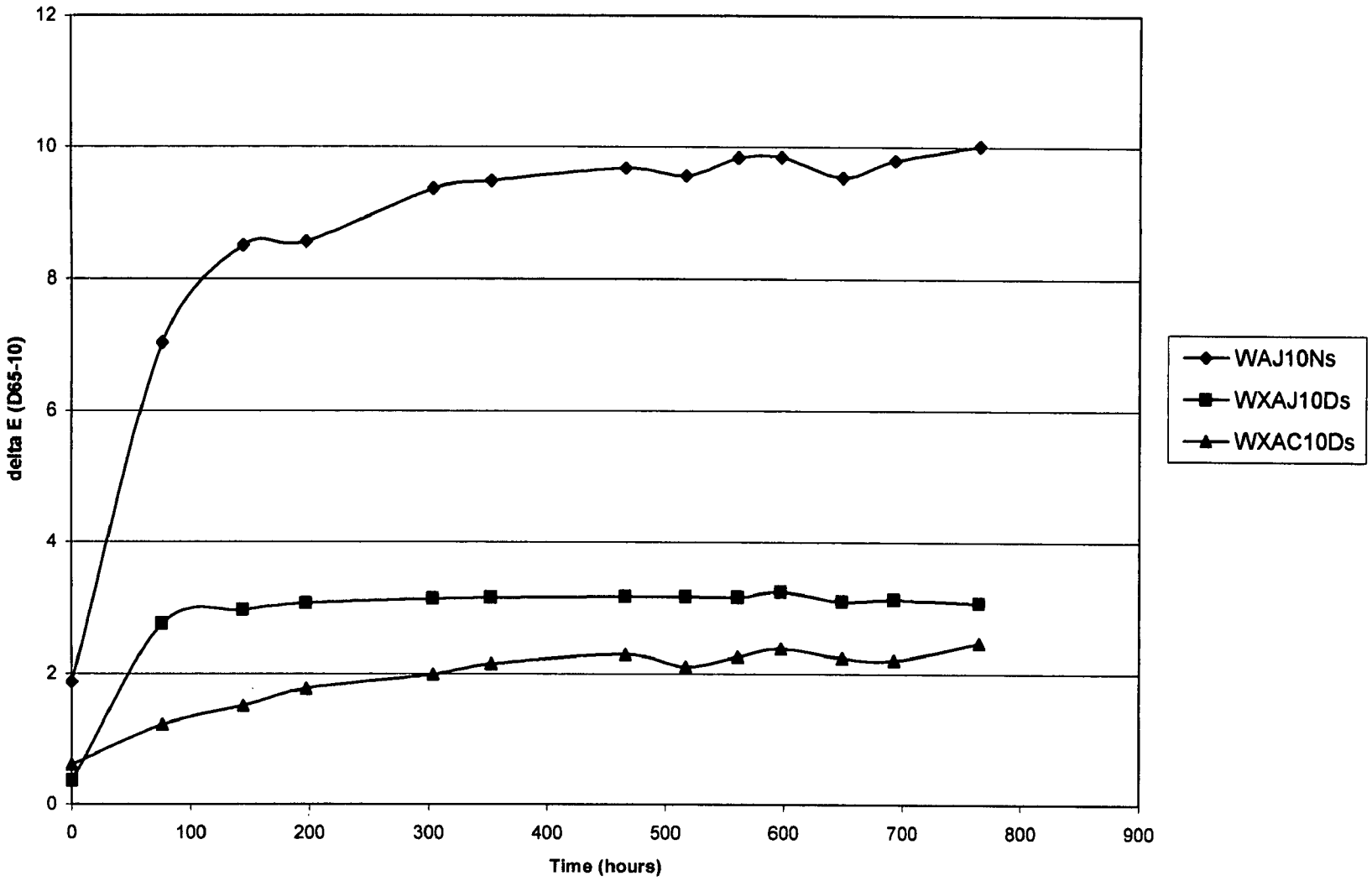
FIG. 2 shows the color change with time of antimicrobially treated white fabrics, within and outside the scope of the present invention, in a Xenon chamber.
Figure 3:
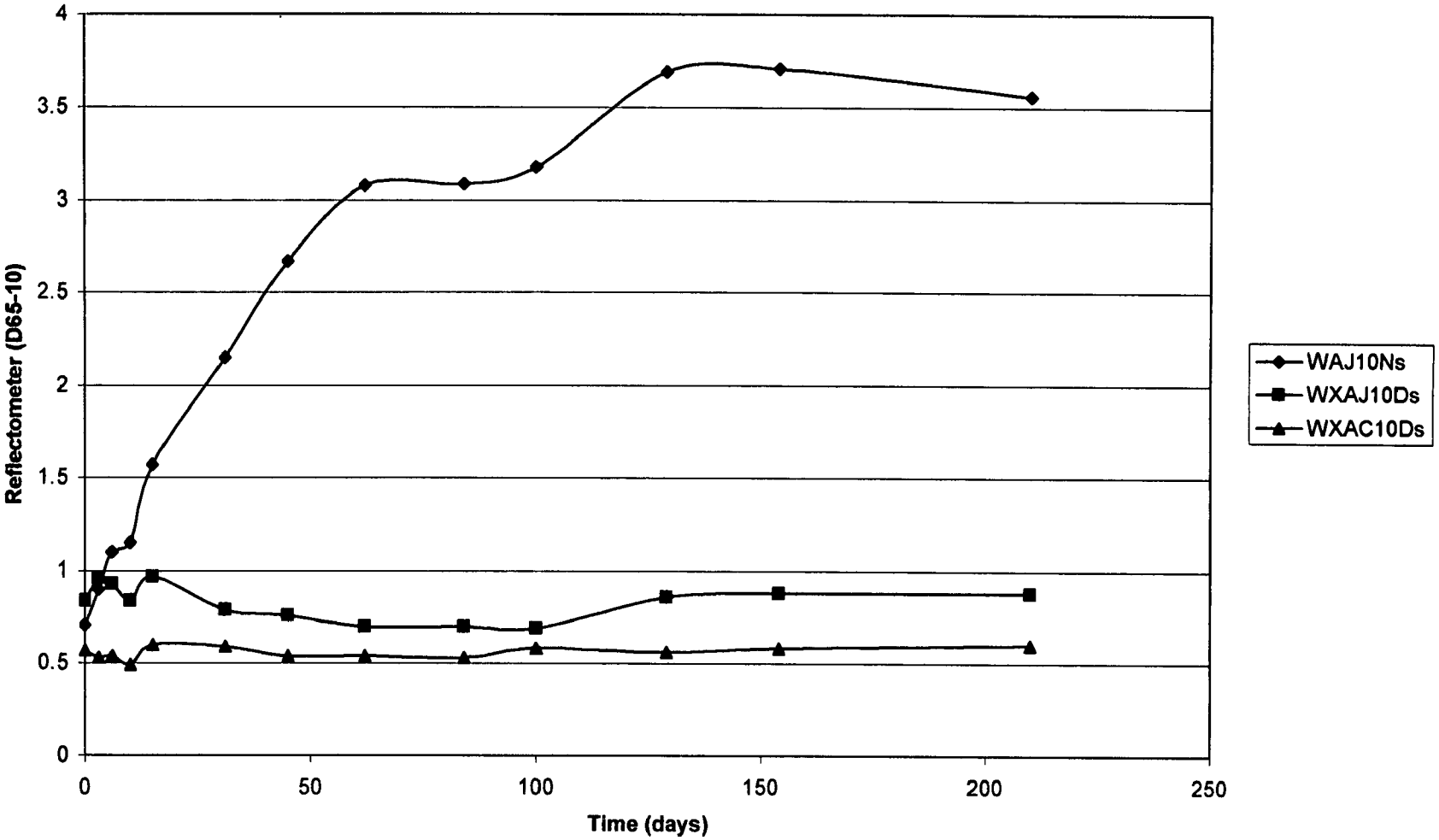
FIG. 3 shows the color change with time of antimicrobially treated white fabrics, within and outside the scope of the present invention, upon natural light exposure after 20 wash cycles.
Figure 4:
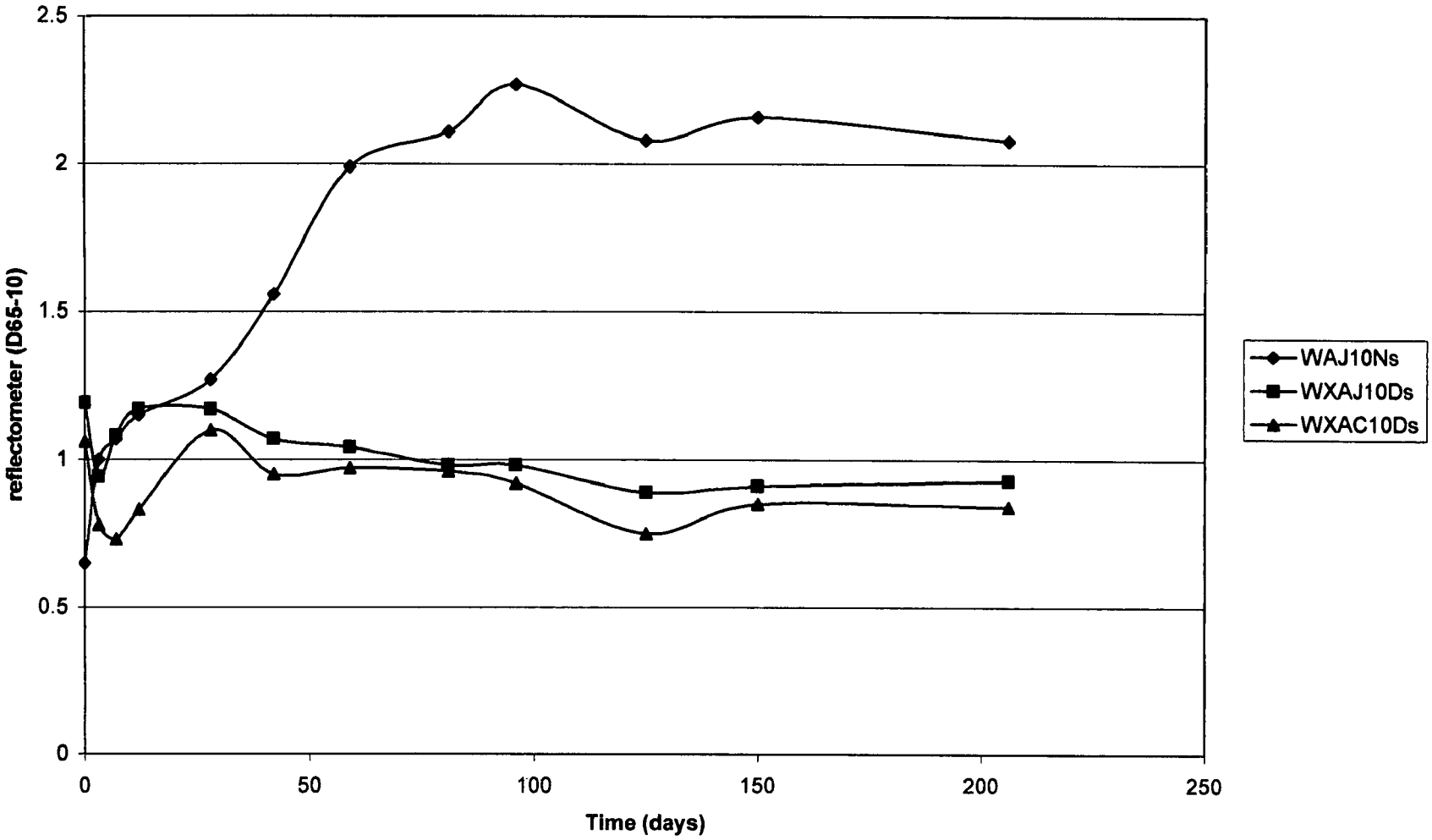
FIG. 4 shows the color change with time of antimicrobially treated white fabrics, within and outside the scope of the present invention, upon natural light exposure after 40 wash cycles.
Figure 5:
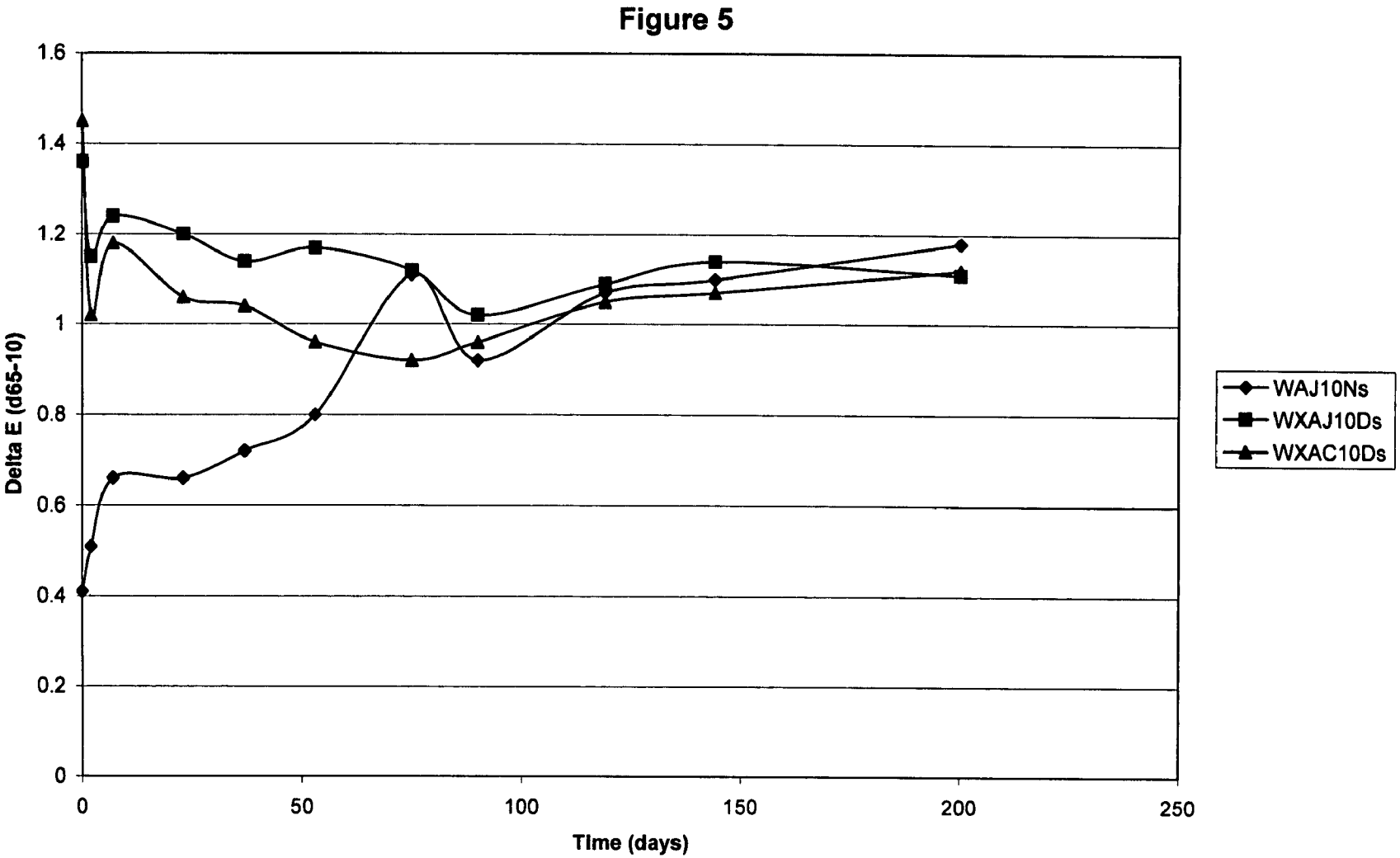
FIG. 5 shows the color change with time of antimicrobially treated white fabrics, within and outside the scope of the present invention, upon natural light exposure after 60 wash cycles.
Figure 6:
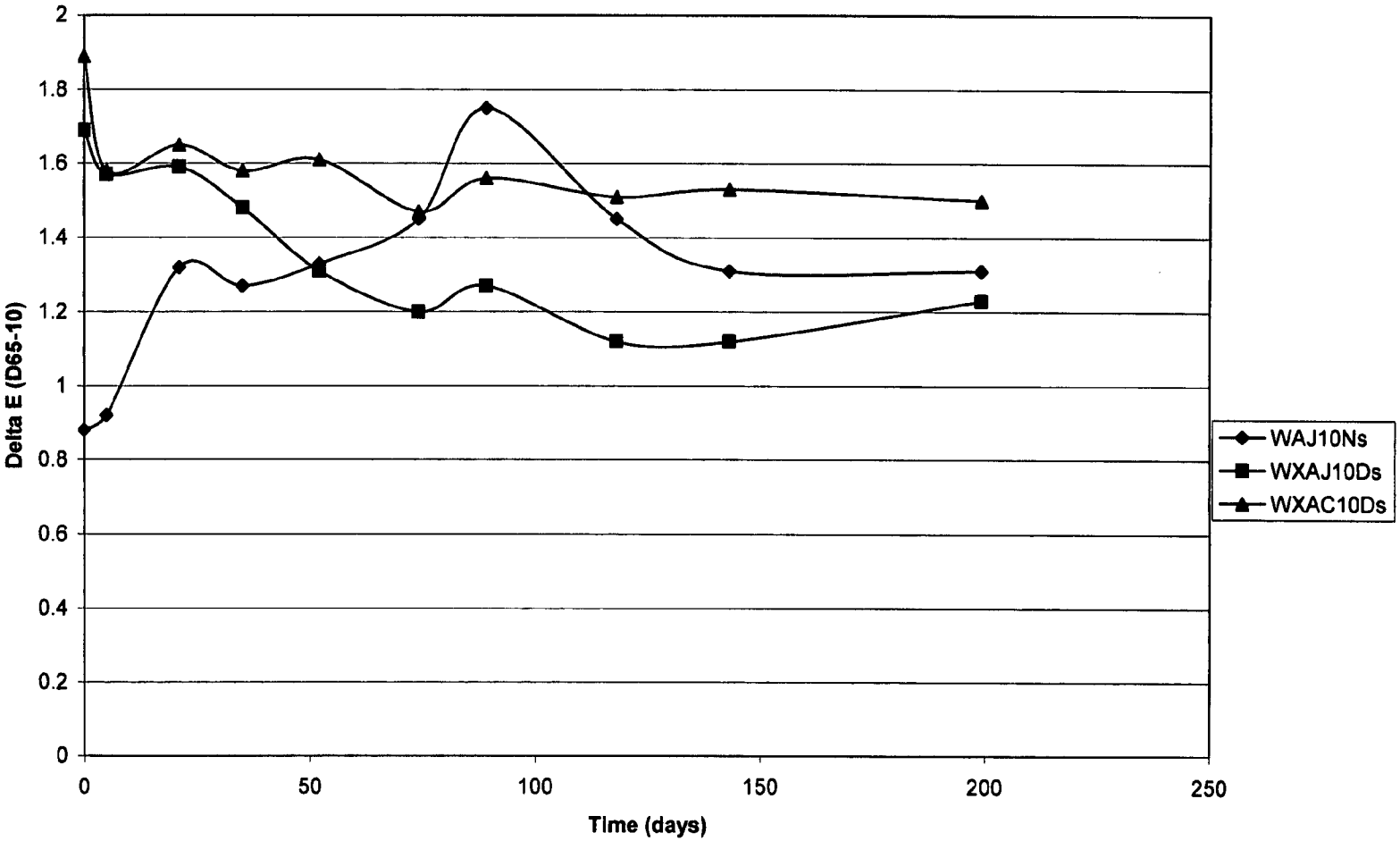
FIG. 6 shows the color change with time of antimicrobially treated white fabrics, within and outside the scope of the present invention, upon natural light exposure after 80 wash cycles.

FIGS. 1 and 2 show the marked color change of the unwashed samples subjected to natural light and the accelerated exposure of a xenon chamber, respectively. As indicated, those samples treated with just the silver zeolite (WAJ10Ns) readily and markedly changed color, from white to a beige and then a darker brown color. The extent of discoloration was such that discoloration in those samples subjected to only natural light were detectable to the naked eye after only 10 days and blatantly apparent after just 60 days.

As also seen in FIGS. 1 and 2, the addition of zinc oxide to the silver only zeolite led to an improvement in the color stability: reducing the degree of discoloration by about half. However, discoloration was still apparent and would continue to increase over time as evidenced by the significant discoloration in the samples subjected to the accelerated exposure conditions.

Only the samples having both the zinc oxide and the silver and copper ion source showed excellent color stability. Although the empirical data would suggest a modest discoloration in these samples, direct observation by the naked eye presented a surprisingly different conclusion. Specifically, while color changes were visible to the naked eye upon close observation, the color change in those samples treated with the zinc oxide and the silver/copper zeolite appeared as an enhanced brilliance, almost a super white. In contrast, the color change in those samples having the zinc oxide and the silver zeolite was of an off-white or light beige tint, more in line with what was seen with the silver zeolite alone. Thus, the antimicrobial treatments according to the present invention not only reduced discoloration but also seemed to provide an improved appearance to the treated textiles. Furthermore, it was particularly surprising that these results were attained in spite of the fact that the inventive textiles employing the zinc oxide and silver/copper zeolite actually contained nearly 40% more silver than the zinc oxide/silver zeolite treated textile.

FIGS. 3 through 6 present the color stability performance in natural light of those samples that had been subjected to various numbers of wash cycles. It is noted that the color shift of all samples lessens and appears to essentially morph or mimic each other as the number of washings increase. Because all washings were done before the samples were set out for exposure, it is believed that the washing effectively depleted the antimicrobial agents of their antimicrobial metal ions, especially the silver ions, that would otherwise interact with other components or contaminants of the treatment and/or textile composition and/or of the latent color forming species that may have been formed upon forming the treatments or applying the same to the textile. In this respect, it is interesting to note that color instability of the samples treated with the silver zeolite slurry still manifested a sharp color shift over time in those samples washed for 20 or 40 wash cycles. This is consistent with the depletion of the ions on and near the surface of the zeolite particles during the wash cycles and the subsequent release, following washing, of those ions held deeper within the zeolite carrier particles until even those zeolite carrier particles are themselves depleted.

It will be appreciated that continuous, repetitive washing does not mimic real-life circumstances where washings would be spread out over time, perhaps once or twice a week for a given article of clothing, a towel or the like, or even less frequently in the case of bedding, curtains, etc. Furthermore, there is likely to be extensive light exposure between washings, the duration of which will vary depending upon the end use application for the fabric, textile, etc. Had the experiments been conducted in a more real life circumstance, perhaps washing every other or third day, discoloration of the comparative fabrics, as opposed to the inventive fabrics, would have been much more pronounced over time: more in line with the unwashed samples.

Generally speaking, as evident from the above results and discussions, it has now been found that one may provide antimicrobial fabrics, especially white fabrics, having improved antimicrobial efficacy, as denoted by enhanced performance longevity, and good color stability by use of a combination of a zinc salt and a copper and silver ion source. These results are particularly surprising since one is able to achieve these results with less silver than would otherwise be needed to achieve the same degree of antimicrobial performance and longevity with similar ion-exchange type antimicrobial agents alone and are able to do so with minimal impact on color.

Although the present invention has been described with respect to the foregoing specific embodiments and examples, it should be appreciated that other embodiments utilizing the concept of the present invention are possible without departing from the scope of the invention. The present invention is defined by the claimed elements and any and all modifications, variations, or equivalents that fall within the spirit and scope of the underlying principles.

We claim:

1. An antimicrobial textile comprising one or more natural or synthetic fibers or filaments having associated therewith an antimicrobial agent said antimicrobial agent comprising a predominant amount of a water soluble zinc salt in combination with at least one source of antimicrobial silver ions and at least one source of copper ions, which may be the same source as the source of the silver ions, wherein the weight ratio of zinc salt to the source(s) of silver and copper ions is from 1:1 to 20:1.

2. The antimicrobial textile of claim 1 comprising from about 0.01 to about 20 percent by weight of the antimicrobial agent, wherein the weight ratio of silver ions to copper ions is from 1:10 to 10:1.

3. The antimicrobial textile of claim 1 comprising from about 0.02 to about 10 percent by weight of the antimicrobial agent, wherein the weight ratio of the zinc salt to the source of silver and copper ions is from 2:1 to 10:1 and the weight ratio of silver ions to copper ions is from 5:1 to 1:5.

4. The antimicrobial textile of claim 1 wherein the source of copper and silver ions is a single source providing both silver and copper ions and is selected from the group consisting of antimicrobial silver and copper metal or metal ion containing water soluble glasses and antimicrobial silver and copper ion containing ion-exchange type antimicrobial agents.

5. The antimicrobial textile of claim 4 wherein the source of copper and silver ions is ion-exchange type antimicrobial agent having both ion-exchanged silver and copper ions.

6. The antimicrobial textile of claim 5 wherein the ion-exchange type antimicrobial agent comprises a ceramic carrier having ion-exchanged antimicrobial metal ions, said ceramic carrier being selected from the group zeolites, calcium phosphates, hydroxyapatites, and zirconium phosphates.

7. The antimicrobial textile of claim 5 wherein the ion-exchange type antimicrobial agent is a zeolite having ion-exchanged silver and copper ions.

8. The antimicrobial textile of claim 1 wherein the source of copper and silver ions is a combination of sources, each source being independently selected from the group consisting of antimicrobial metal or metal ion containing water soluble glasses and antimicrobial metal ion containing ion-exchange type antimicrobial agents, at least one of which is a source of silver ions and at least one of which is a source of copper ions.

9. The antimicrobial textile of claim 8 wherein the ion-exchange type antimicrobial agent comprises a ceramic carrier having ion-exchanged antimicrobial metal ions, said ceramic carrier being selected from the group zeolites, calcium phosphates, hydroxyapatites, and zirconium phosphates.

10. The antimicrobial textile of claim 8 wherein the source of copper and silver ions is a combination of an ion-exchange type antimicrobial agent having both ion-exchanged silver and copper ions and either a second ion-exchange type antimicrobial agent having silver ions but no copper ions or a water soluble glass having silver metal or silver ions but not copper metal or copper ions or both.

11. The antimicrobial textile of claim 10 wherein both sources are antimicrobial zeolites.

12. The antimicrobial textile of claim 1 wherein the textile is in the form of a fiber, yarn, filament, fabric, or textile.

13. The antimicrobial textile of claim 1 wherein the antimicrobial agent is impregnated into or coated onto the surface of the textile.

14. The antimicrobial textile of claim 13 wherein a binder system adheres the antimicrobial agent to the textile.

15. The antimicrobial textile of claim 1 wherein the textile comprises synthetic fibers or filaments, alone or in combination with natural fibers or filaments, and the antimicrobial agent is impregnated into, coated onto or incorporated into the synthetic fibers or filaments.

16. The antimicrobial textile of claim 15 wherein the antimicrobial agent is adhered to the surface of the synthetic fibers or filaments by a binder system.

17. The antimicrobial textile of claim 15 wherein the antimicrobial agent is impregnated into the surface of the synthetic fibers or filaments, such impregnation having been achieved by the use of a solvent capable of swelling the synthetic polymer comprising the synthetic fiber or filament in combination with the antimicrobial agent, which solvent sufficiently swells the synthetic polymer so as to allow the antimicrobial agent to infuse into the swelled polymer material prior to driving off the solvent.

18. The antimicrobial textile of claim 15 wherein the antimicrobial agent is incorporated into the synthetic polymer material from which the synthetic fibers or filaments are made prior to making the same.

19. The antimicrobial textile of claim 18 wherein the synthetic fiber or filament is a core-sheath type fiber or filament wherein the antimicrobial agent is incorporated into the polymer comprising the sheath, the core or both.

20. The antimicrobial textile of claim 1 wherein the water soluble zinc salt is selected from the group consisting of zinc salts of carboxylic acids, zinc oxide, zinc acetate, zinc borate, zinc nitrate, zinc sulfate, zinc chloride, zinc bromide, zinc nitrate, zinc hydrophosphite, zinc oxalate, zinc oleate, and zinc peroxide.

* * * * *